US011154102B1

(12) United States Patent
Ahearn

(10) Patent No.: US 11,154,102 B1
(45) Date of Patent: Oct. 26, 2021

(54) SELF-ADHESIVE NASAL MASK

(71) Applicant: David J. Ahearn, Little Compton, RI (US)

(72) Inventor: David J. Ahearn, Little Compton, RI (US)

( * ) Notice: Subject to any disclaimer, the term of this patent is extended or adjusted under 35 U.S.C. 154(b) by 0 days.

(21) Appl. No.: 17/236,668

(22) Filed: Apr. 21, 2021

Related U.S. Application Data

(60) Provisional application No. 63/015,106, filed on Apr. 24, 2020.

(51) Int. Cl.
*A41D 13/11* (2006.01)
*A62B 18/08* (2006.01)
*A62B 23/02* (2006.01)

(52) U.S. Cl.
CPC ..... *A41D 13/1169* (2013.01); *A62B 18/084* (2013.01); *A62B 23/025* (2013.01)

(58) Field of Classification Search
CPC ..... A41D 13/1169; A41D 13/1161; A41D 13/11; A41D 13/1123; A41D 13/1218; A62B 18/084; A62B 23/025; A62B 18/08; A62B 18/02; A62B 18/00; A62B 23/06; A62B 23/02; A62B 9/06; A62B 7/00; A62B 9/04
See application file for complete search history.

(56) References Cited

U.S. PATENT DOCUMENTS

| | | | | |
|---|---|---|---|---|
| 5,711,026 | A | 1/1998 | Kaltman et al. | |
| 5,727,544 | A * | 3/1998 | Miura | A41D 13/11 128/201.13 |
| 6,453,902 | B1 * | 9/2002 | Hollander | A41D 13/1176 128/201.12 |
| 7,506,649 | B2 | 3/2009 | Doshi et al. | |
| 8,302,607 | B2 | 11/2012 | Pierce et al. | |
| 8,555,413 | B2 * | 10/2013 | Beliveau | A61F 9/029 2/9 |
| 2005/0161046 | A1 | 7/2005 | Michaels | |
| 2008/0223371 | A1 * | 9/2008 | Guillory | A62B 23/06 128/206.18 |
| 2013/0109992 | A1 | 5/2013 | Guyette | |

* cited by examiner

*Primary Examiner* — Tarla R Patel
(74) *Attorney, Agent, or Firm* — Adler Pollock & Sheehan P.C

(57) ABSTRACT

A self-adhesive nasal mask includes a main body shaped to form to and cover a contour of a nose on a face of a user, the main body including peripheral tabs, each of the peripheral tabs including a lateral self-adhesive strip on an underside facing the face of the user, the main body constructed from a material that impedes unfiltered exhales from the user.

13 Claims, 5 Drawing Sheets

SELF-ADHESIVE NASAL MASK

CROSS REFERENCE TO RELATED APPLICATIONS

This application claims benefit from U.S. Provisional Patent Application Ser. No. 63/015,106, filed Apr. 24, 2020, which is incorporated by reference in its entirety.

BACKGROUND OF THE INVENTION

The present invention generally relates to masks, and more specifically to a self-adhesive nasal mask.

In general, Various types of masks are available for preventing inhalation by the user of harmful substances such as chemicals or dust in a manufacturing environment. These masks typically are constructed of one or more layers of a material that filters out larger particles but allows respiration of the user. Some masks are used in a hospital or surgical environment primarily to shield a patient from water or airborne bacteria emanating from a doctor's mouth.

SUMMARY OF THE INVENTION

The following presents a simplified summary of the innovation in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In an aspect, the invention features a self-adhesive nasal mask including a main body shaped to form to and cover a contour of a nose on a face of a user, the main body including peripheral tabs, each of the peripheral tabs including a lateral self-adhesive strip on an underside facing the face of the user, the main body constructed from a material that impedes unfiltered exhales from the user.

In another aspect, the invention features a self-adhesive nasal mask including a main body shaped to form to and cover a contour of a nose on a face of a user, the main body providing an impediment to unfiltered exhales from the nose of the user, two peripheral tabs located opposite each other on the main body, and a band affixed to a lower portion of the main body.

These and other features and advantages will be apparent from a reading of the following detailed description and a review of the associated drawings. It is to be understood that both the foregoing general description and the following detailed description are explanatory only and are not restrictive of aspects as claimed.

BRIEF DESCRIPTION OF THE DRAWINGS

The invention will be more fully understood by reference to the detailed description, in conjunction with the following figures, wherein.

DETAILED DESCRIPTION

Figure 1:
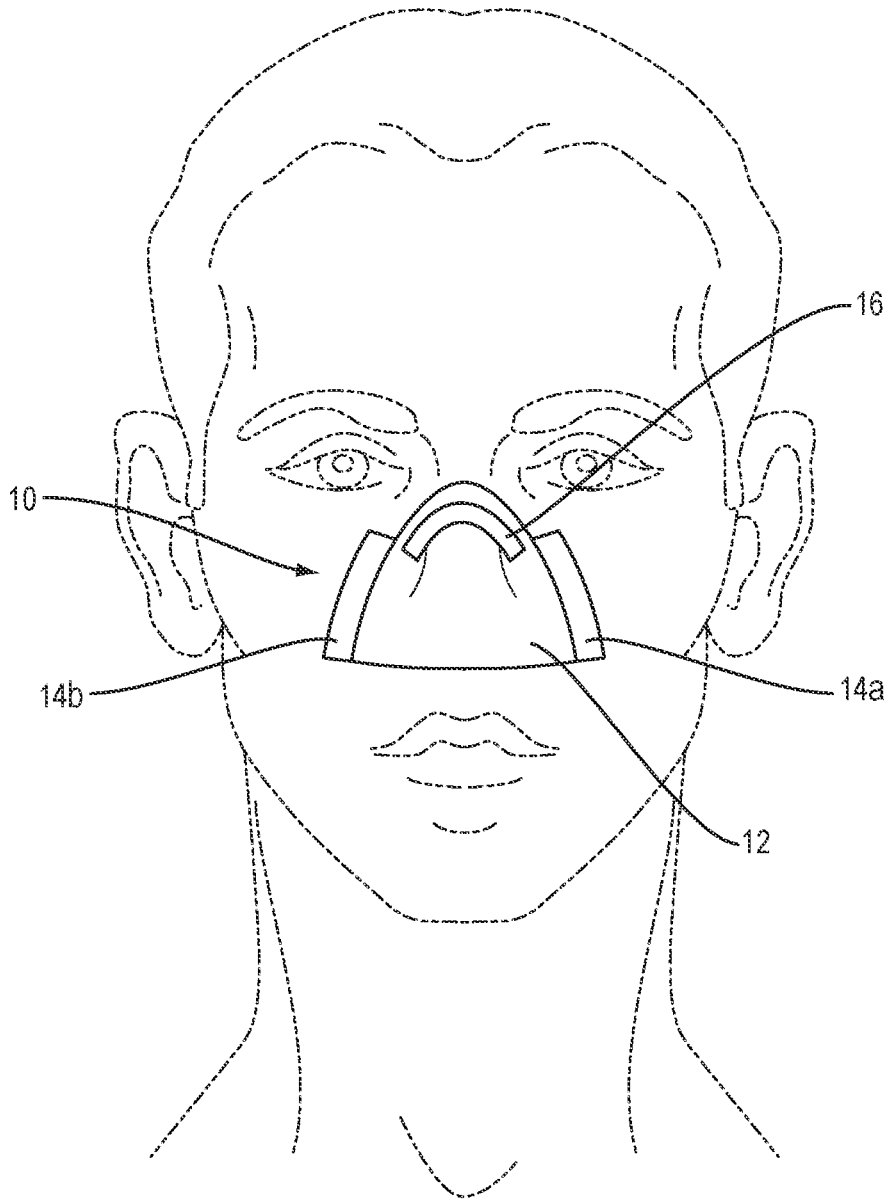
FIG. 1 illustrates a front prospective view of an exemplary self-adhesive nasal mask.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

The subject innovation is now described with reference to the drawings, wherein like reference numerals are used to refer to like elements throughout. In the following description, for purposes of explanation, numerous specific details are set forth in order to provide a thorough understanding of the present invention. It may be evident, however, that the present invention may be practiced without these specific details. In other instances, well-known structures and devices are shown in block diagram form in order to facilitate describing the present invention.

This present invention provides a self-adhesive nasal mask that provides a simple, comfortable and disposable impediment to unfiltered exhales, e.g., nasal breaths and sneezes, from a user, such as, for example, a patient.

As shown in FIG. 1, a front prospective view of an exemplary self-adhesive nasal mask 10 includes a main body 12 shaped to form to and cover a contour of a nose of a user. The main body 12 includes peripheral tabs 14*a*, 14*b*. Each of the peripheral tabs 14*a*, 14*b* includes a lateral self-adhesive strip (not shown) on an underside facing a face of the user. The lateral self-adhesive strips function to secure the peripheral tabs 14*a*, 14*b*, and thus the main body 12, to the face of the user. With such an arrangement, the main body 12 is easily secured to or removed from the face of the user. Once applied and attached to the user's face, the main body 12 provides an impediment to unfiltered exhales from the user.

In the embodiment shown, the main body 12 includes deformable/shapable metal or plastic strip 16 on an upper portion. The presence of the strip 16 enables a user or caregiver an ability to more closely shape a top of the main body 12 to a bridge of the user's nose. A close fit results results in improved prevention of unfiltered exhales from the user.

In an embodiment, the main body 12 is constructed of a non-woven fabric, which has better bacteria filtration and air permeability while remaining less slippery than woven cloth. In a preferred embodiment, the main body 12 is constructed from polypropylene, either 20 or 25 grams per square meter (gsm) in density. However, it should be appreciated that the main body 12 may be constructed from other materials, such as polystyrene, polycarbonate, polyethylene, polyester, and so forth.

Figure 2:
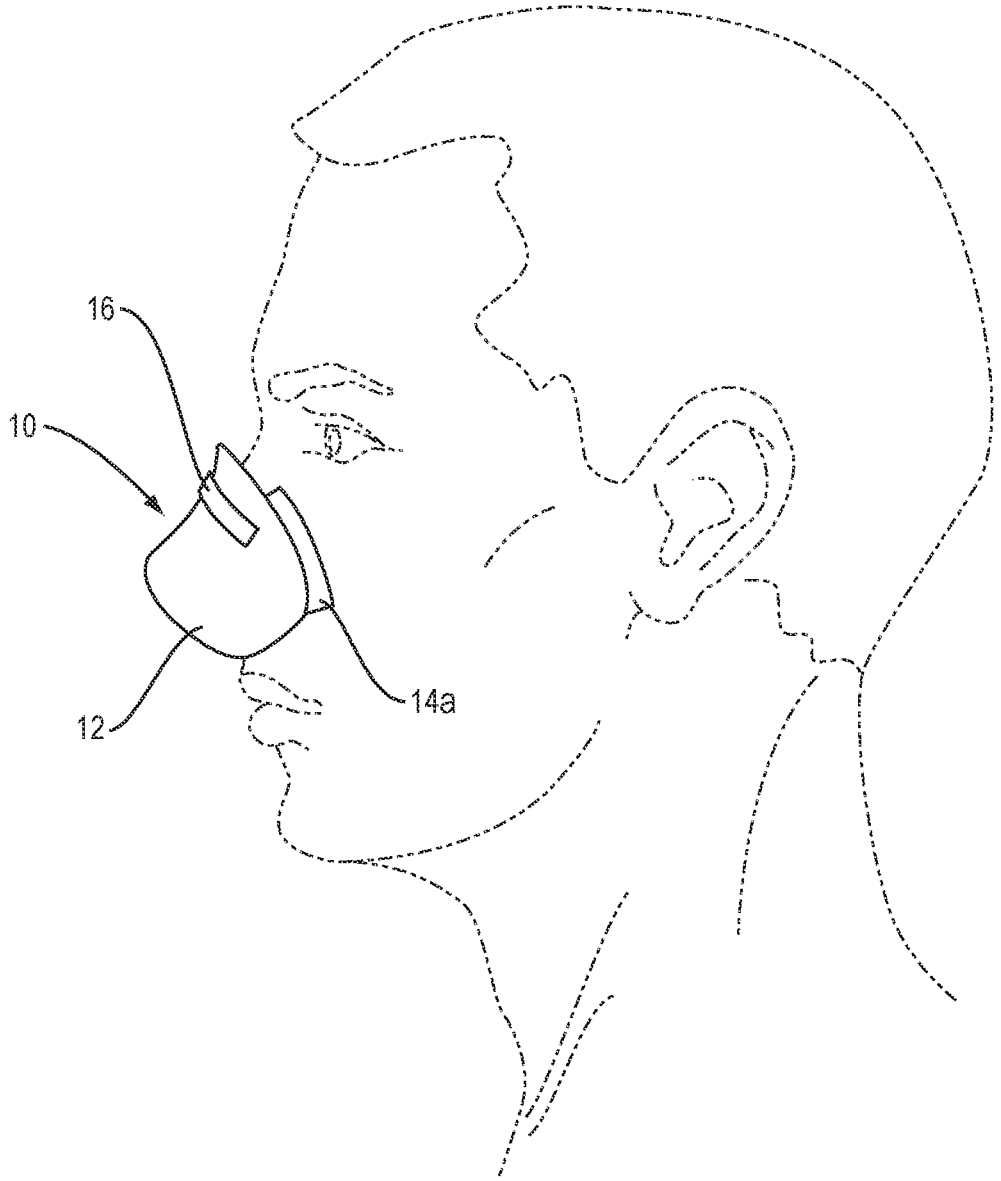
FIG. 2 illustrates a side prospective view of the exemplary self-adhesive nasal mask.

In FIG. 2, a side prospective view of the exemplary self-adhesive nasal mask 10 is shown to better illustrate how the main body 12 is contoured to the shape of the nose of the user.

Figure 3:
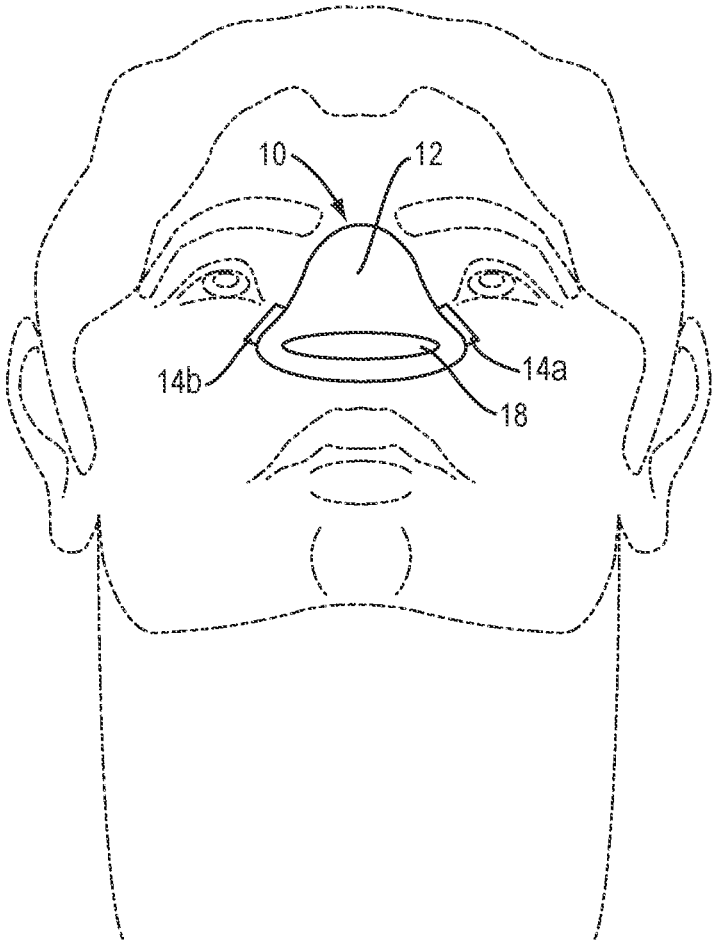
FIG. 3 illustrates a front upper prospective view of the exemplary self-adhesive nasal mask.

In FIG. 3, a front upper prospective of the exemplary self-adhesive nasal mask 10 is shown to better illustrate a lower portion of the main body 12 under the nostrils and above the lip of the user. In one specific embodiment, a rigid or semi-rigid band 18 is affixed to an exterior lower portion of the main body 12 to provide additional structure for sealing the lower portion of the main body 12 to the lip region of the user's face.

Figure 4:
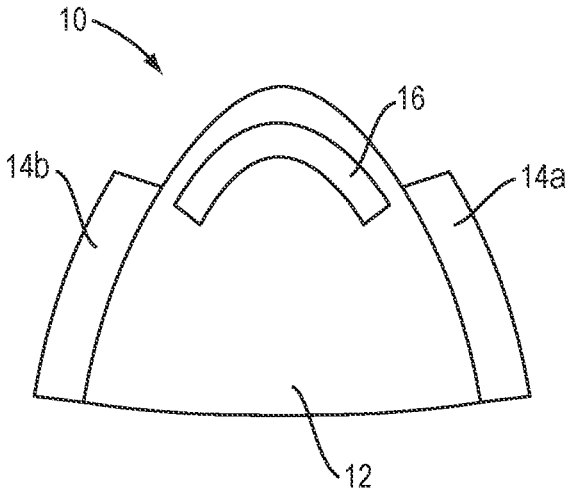
FIG. 4 illustrates the exemplary self-adhesive nasal mask.
Figure 5:
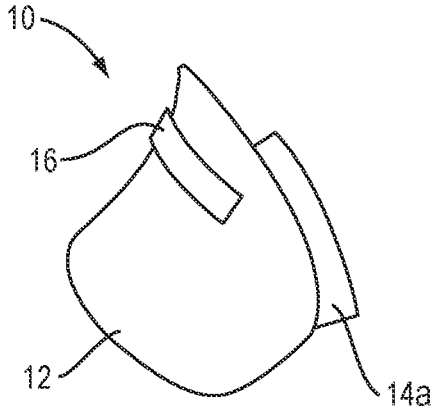
FIG. 5 illustrates the exemplary self-adhesive nasal mask.

FIGS. 4 and 5 illustrate a front and side view, respectively, of the self-adhesive nasal mask 10.

Figure 6:
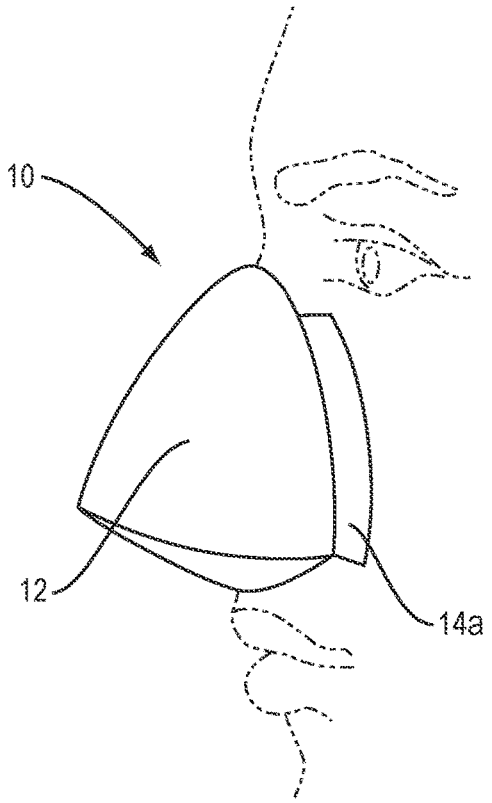
FIG. 6 illustrates another side prospective view of the exemplary self-adhesive nasal mask.

FIG. 6 illustrates another side prospective view of the exemplary self-adhesive nasal mask 10.

Figure 7:
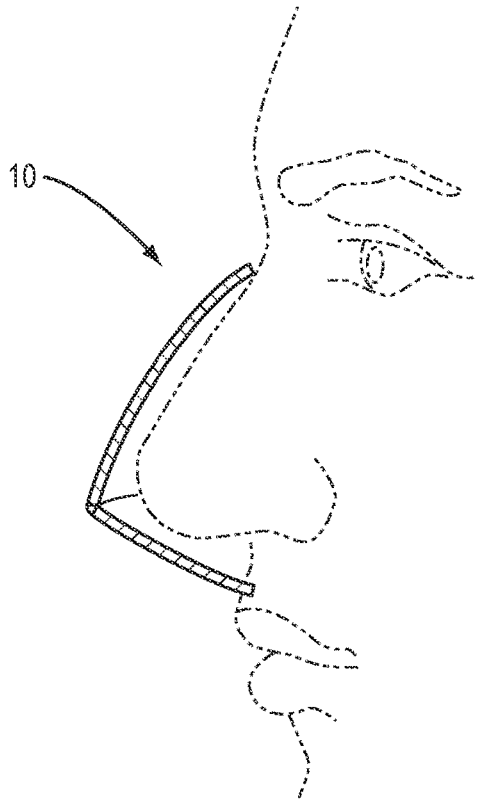
FIG. 7 illustrates a cross-section of the exemplary self-adhesive nasal mask.

FIG. 7 illustrates a cross-section of the exemplary self-adhesive nasal mask 10.

Figure 8:
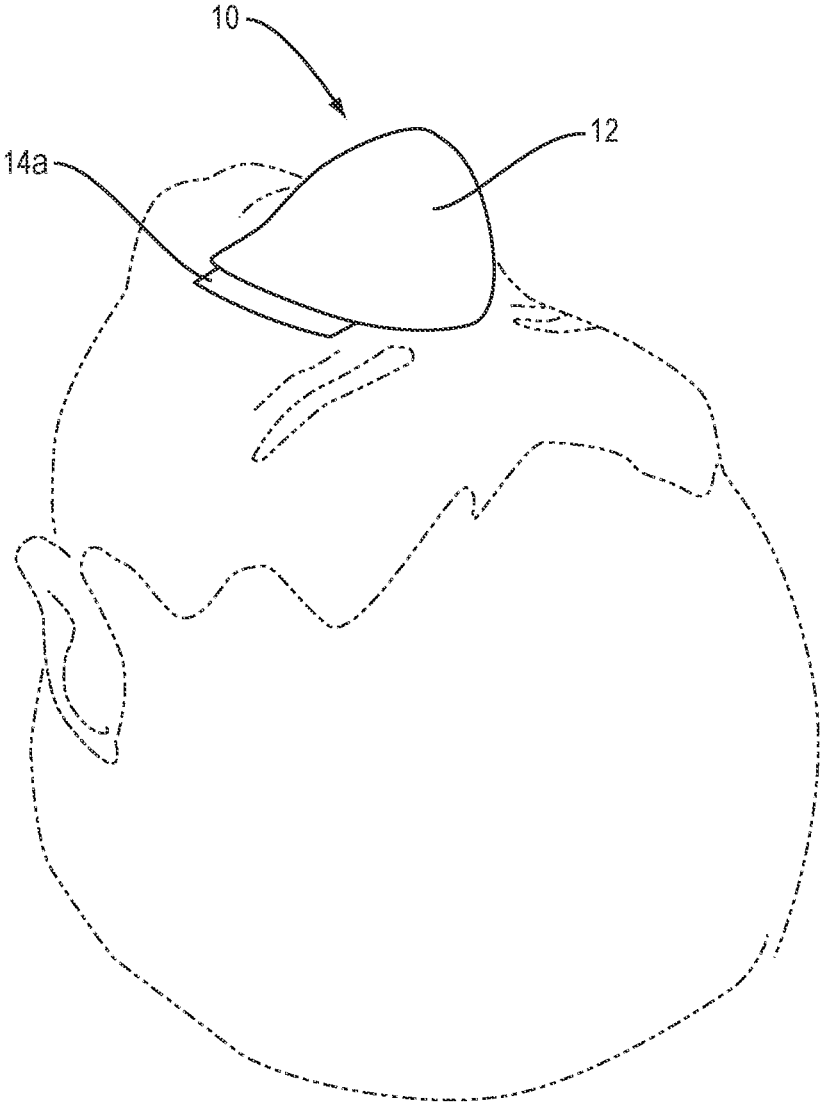
FIG. 8 illustrates a top prospective view of the exemplary self-adhesive nasal mask.

FIG. 8 illustrates a top prospective view of the exemplary self-adhesive nasal mask 10.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. A self-adhesive nasal mask comprising:

a main body shaped to form to and cover a contour of a nose on a face of a user, the main body comprising peripheral tabs, each of the peripheral tabs including a lateral self-adhesive strip on an underside facing the face of the user, the main body constructed from a material that impedes unfiltered exhales from the user wherein the main body further comprises a deformable/shapable metal or plastic strip positioned its upper portion to enable the user an ability to closely shape a top of the main body to a bridge of the user's nose and wherein the main body further comprises a rigid or semi-rigid band affixed to a lower portion to provide additional structure for sealing the lower portion of the main body to a lip region of the user's face.

2. The self-adhesive nasal mask of claim 1 wherein the material is a non-woven fabric.

3. The self-adhesive nasal mask of claim 2 wherein the non-woven fabric is selected from the group consisting of polypropylene, polystyrene, polycarbonate, polyethylene and polyester.

4. A self-adhesive nasal mask comprising:

a main body shaped to form to and cover a contour of a nose on a face of a user, the main body providing an impediment to unfiltered exhales from the nose of the user;

two peripheral tabs located opposite each other on the main body; and a band affixed to a lower portion of the main body wherein the main body further comprises a deformable/shapable metal or plastic strip positioned its upper portion to enable the user an ability to closely shape a top of the main body to a bridge of the user's nose and wherein the main body further comprises a rigid or semi-rigid band affixed to a lower portion to provide additional structure for sealing the lower portion of the main body to a lip region of the user's face.

5. The self-adhesive nasal mask of claim 4 wherein each of the peripheral tabs includes a lateral self-adhesive strip on an underside facing the face of the user to enable securing the main body over the nose on to the nose.

6. The self-adhesive nasal mask of claim 5 wherein the main body is constructed of a non-woven fabric.

7. The self-adhesive nasal mask of claim 6 wherein the non-woven fabric is polypropylene having a density of 20-25 grams per square meter (gsm).

8. The self-adhesive nasal mask of claim 5 wherein the main body is constructed of polystyrene.

9. The self-adhesive nasal mask of claim 5 wherein the main body is constructed of polycarbonate.

10. The self-adhesive nasal mask of claim 5 wherein the main body is constructed of polyethylene.

11. The self-adhesive nasal mask of claim 5 wherein the main body is constructed of polyester.

12. The self-adhesive nasal mask of claim 4 wherein the band is rigid.

13. The self-adhesive nasal mask of claim 4 wherein the band is semi-rigid.

* * * * *